US009010243B2

(12) United States Patent
Izawa et al.

(10) Patent No.: US 9,010,243 B2
(45) Date of Patent: Apr. 21, 2015

(54) DIGITAL SHEET-FED PRINTING METHOD

(75) Inventors: Hideo Izawa, Narashino (JP); Kenji Takahashi, Narashino (JP); Hidenori Kosaka, Narashino (JP)

(73) Assignee: Miyakoshi Printing Machinery Co., Ltd., Narashino-shi (JP)

( * ) Notice: Subject to any disclaimer, the term of this patent is extended or adjusted under 35 U.S.C. 154(b) by 453 days.

(21) Appl. No.: 13/601,354

(22) Filed: Aug. 31, 2012

(65) Prior Publication Data

US 2013/0061770 A1 Mar. 14, 2013

(30) Foreign Application Priority Data

Sep. 9, 2011 (JP) ..... 2011-197003

(51) Int. Cl.

| | |
|---|---|
| ***B41J 11/46*** | (2006.01) |
| ***B41F 1/34*** | (2006.01) |
| ***B41J 13/22*** | (2006.01) |
| ***B41J 11/00*** | (2006.01) |

(52) U.S. Cl.

CPC ..... *B41J 13/223* (2013.01); *B41J 11/008* (2013.01)

(58) Field of Classification Search

CPC ..... B41J 11/46; B41J 13/223; B41J 11/008; B41J 2/21; B41J 29/38; G03G 2215/0161; G03G 2215/0158

USPC ..... 101/171, 177, 181, 183, 423, 425, 483, 101/485, 486; 347/5, 14, 104; 400/62, 76

See application file for complete search history.

(56) References Cited

U.S. PATENT DOCUMENTS

| | | | | |
|---|---|---|---|---|
| 4,528,630 | A * | 7/1985 | Sargent | 700/125 |
| 4,650,019 | A * | 3/1987 | Yanai et al. | 180/444 |
| 7,040,232 | B2 * | 5/2006 | Van Holten et al. | 101/484 |
| 2009/0123206 | A1 * | 5/2009 | Schnabel et al. | 400/76 |
| 2010/0058944 | A1 * | 3/2010 | Kaiser et al. | 101/177 |

FOREIGN PATENT DOCUMENTS

| | | | |
|---|---|---|---|
| DE | 101 23 881 | A1 | 11/2001 |
| JP | 10-128947 | A | 5/1998 |
| JP | 2004-276382 | A | 10/2004 |
| WO | 2011/105131 | A1 | 9/2011 |

OTHER PUBLICATIONS

Extended European Search Report dated Dec. 6, 2012, issued in corresponding European Patent Application No. 12183413.9 (3 pages).

* cited by examiner

*Primary Examiner* — Leslie J. Evanisko
*Assistant Examiner* — Marissa Ferguson Samreth
(74) *Attorney, Agent, or Firm* — Westerman, Hattori, Daniels & Adrian, LLP

(57) ABSTRACT

A digital sheet-fed printing method includes providing one cycle of printing to print on a series of sheets of paper whose number is equal to the least common multiple of respective numbers of allocated positions; producing a reference signal on the basis of which an image in each color is printed on the sheet of paper; detecting with an image detection sensor means a mutual out of register between images in different colors printed on each sheet of paper in the series, furnishing the printing control means with a detection signal for each sheet of paper from the image detection sensor, and correcting the timing at which each image is printed on each sheet of paper in one cycle of printing so that timings to print the images in different colors on each sheet of paper coincide with one another; and printing images in the different colors.

14 Claims, 2 Drawing Sheets

DIGITAL SHEET-FED PRINTING METHOD

TECHNICAL FIELD

The present invention relates to a digital sheet-fed printing method for printing images of a plurality of colors on one side of a sheet of paper with a plurality of printing units each made of a digital printer such as an ink jet printer or electrophotographic printer. In particular, the invention relates to a digital sheet-fed printing method for multi-color printing by printing of each color with each printing unit in which a plurality of sheets of paper are successively transported with a plurality of transport cylinders as provided between adjacent ones of such printing units, respectively, the cylinders allowing such sheets of paper to be transported thereon while being retained at their circumferentially uniformly distributed allocated positions.

BACKGROUND ART

Such a plurality of transport cylinders include an impression cylinder opposite to a printing unit and a pair of delivery cylinders positioned at both sides of the impression cylinder in its transport direction for delivering a sheet of paper onto and from the impression cylinder. Each of these cylinders is provided on its peripheral surfaces with grippers whereby sheets of papers are retained as they are uniformly distributed on the peripheral surface while being transported with the cylinder.

In a printing machine using grippers and in which a sheet of paper is transported, by being delivered, from a delivery cylinder onto an impression cylinder and then onto another delivery cylinder, the sheet of paper is delivered and transported while being gripped in turns by such grippers mounted on the peripheral surface of each cylinder. The grippers on each cylinder are mounted upon being allocated circumferentially thereof. A gripper for each cylinder is allocated and mounted thereon at a precision peculiar to its peripheral length, and grippers are incorporated into each cylinder at their mounting position at their individual assembly precisions, respectively.

Thus, where a sheet of paper is being transported from a delivery cylinder onto an impression cylinder and further onto another delivery cylinder while being gripped in turns, depending on mounting positions of the grippers there are introduced a small inherent error in the timing of gripping in turns, which causes an error in each transport of the sheet of paper and in its turn a mutual deviation between images printed.

For this, in a printing machine in which a sheet of paper is transported on a plurality of cylinders with grippers all the cylinders may be made identical in diameter, which may prevent an error in transport due to a gripper from being accumulated while the sheet of paper is in transport over between a plurality of printing units (see, e.g., JP H10-128947 A).

In a printing machine using grippers with which a sheet of paper are transported by being delivered from a delivery cylinder onto an impression cylinder and further onto another delivery cylinder, it is advantageous, for example, to use the impression cylinder having a peripheral length two times greater than a length of the sheet of paper in its transport direction and the delivery cylinder having a peripheral length three times greater than the length of the sheet of paper, and to use two and three grippers mounted respectively on the peripheral surfaces of the impression and delivery cylinders. Gripped, delivered and re-gripped, the sheet of paper in transport when it comes on a surface of the impression cylinder with which a printing unit is juxtaposed is printed on thereby. Then, referring to FIG. 2 where grippers mounted at circumferentially allocated positions on the impression cylinder as a twofold cylinder (a cylinder having two grippers) are assumed to be a and b and grippers mounted at circumferentially allocated positions on the delivery cylinder as a threefold cylinder (a cylinder having three grippers) are assumed to be x, y and z, successive sheets of paper successively delivered from the delivery cylinder onto the impression cylinder are specifically delivered successively between a and x, b and y, a and z, b and x, a and y and b and z. A problem here arises that each allocated position used for delivery may come to be varied for each sheet of paper in transport. It has been difficult to adjust a sheet transport precision by making an individual error adjustment for each gripper.

For this, in a printing machine with an impression and a delivery cylinder having their respective peripheral lengths which are two and three times of the length of a sheet of paper in its transport direction as mentioned above, high-precision machining and high-precision assembly of individual grippers are required. Also, high-precision adjusting devices are necessary. These needs bring about problems of lengthy periods of adjustment time and raised cost of manufacturing equipment With an impression and a delivery cylinder identical in peripheral length, too, if they are such as two-, three-, fourfold cylinders each provided on its peripheral surface with a plurality of grippers, mutual mechanical register adjustments of these grippers have been time-consuming and hard to make.

In view of the foregoing, it is an object of the present invention to provide a digital sheet-fed printing method that is capable of non-mechanically adjusting and eliminating a mutual deviation between images printed by a plurality of printing units in a digital sheet-fed printing machine using a plurality of transport cylinders.

DISCLOSURE OF THE INVENTION

In order to achieve the object mentioned above, there is provided in accordance with the present invention a digital sheet-fed printing method for multi-color printing on a sheet of paper with a plurality of printing units of digital type, each for printing in each of different colors, in which sheets of paper are successively transported through the printing units with a plurality of transport cylinders individually having a peripheral length that allows sheets of paper to be transported thereon while being retained at their circumferentially uniformly distributed allocated positions, wherein the method comprises: providing one cycle of printing to print on a series of sheets of paper whose number is equal to the least common multiple of respective numbers of such distributed allocated positions on adjacent ones of the transport cylinders; for each sheet of paper in the series to be printed in the one cycle of printing, producing a reference signal on the basis of which an image in each color is printed on the sheet of paper with each printing unit, timed to its passage through the printing unit, under control by a printing control means; in a first of such cycles of printing, detecting with an image detection sensor means a mutual out of register between images in different colors printed on each sheet of paper in the series, furnishing the printing control means with a detection signal for each sheet of paper from the image detection sensor means, and correcting the timing at which each image is printed on each sheet of paper in one cycle of printing by the printing control means and on the basis of such detection signals so that timings to print the images in different colors on each sheet of paper may be coincided with one another; and in each subsequent printing cycle, printing images in the different colors on each sheet of paper at a printing timing as corrected as aforesaid.

In a digital sheet-fed printing method as set forth above, the mutual out of register between images in different colors printed on each sheet of paper printed in the first printing cycle may be detected by detecting one of: (i) an amount of deviation in distance between a timing mark contained in an image in each color and an end of each sheet of paper in its transport direction; and (ii) an amount of deviation between a timing mark contained in one of images in different colors and a timing mark contained in another of the images.

Further in a digital sheet-fed printing method as set forth above, the image detection sensor means may be adapted to detect the timing at which an image passes immediately after the image is printed on each sheet of paper in the first cycle of printing to compensate for an error in timing between a detection signal detected by the image detection sensor means and the reference signal produced for each printing in each color on a sheet of paper by the printing control means.

Also, the image detecting sensor means may comprise one of a measuring camera and a mark sensor.

Further, the printing unit of digital type may comprise one of an ink jet printer and an electrophotographic printer.

Also, in a digital sheet-fed printing method as set forth above, the adjacent ones of the transport cylinders with which sheets of paper are successively transported through the printing units may comprise an impression cylinder to which a printing unit is opposite and one of a pair of delivery cylinders positioned at upstream and downstream sides of the impression cylinder in its transporting direction, wherein the impression and delivery cylinders have their peripheral lengths which are varied from each other such as being two and three times, respectively, of a length of the sheet of paper in its transport direction.

According to the present invention, a mutual deviation between images printed by printing units in a digital sheet-fed printing machine using a plurality of transport cylinders can be corrected not by mechanical means but by means of a printing control whereby a printing register error by errors in mechanical shape and assembly, so called mechanical shape errors which hitherto has not completely be removed can be eliminated. And, the adjusting operations such as accuracy inspection and re-assembling adjustment which have hitherto been required in the art to improve on assembly errors as well as the time periods required for such operations can largely be reduced.

Also, as to the machining precision of impression and delivery cylinders that make up transport cylinders, rather than aiming at an extreme precision improvement it is possible to obtain printed matters of an acceptable precision quality by the necessary and minimum machining accuracy. A reduction in a wide range of costs including machining, assembly and adjustment costs can thus be achieved.

Also, according to the present invention, it is possible to optionally select varied peripheral lengths of a plurality of transport cylinders such as being two and three times of a length of a sheet of paper in its transport direction. The degree of freedom on design to meet with a required specification can thus be expanded, making it possible to extensively meet with specifications of printed matter products.

And, the adjustment function to achieve a mechanical registration precision can be attained in a necessary and minimum structure, making it possible to simplify the equipment while achieving diverse effects including an improvement in workability and a reduction in cost.

Further, data of correction values for use in a printing cycle subsequent to the first cycle for printing patterns are those for fixed values and hence cannot, when outputted, be a cause leading to a reduction in printing speed. A system can, therefore, be provided that can meet with requirements for high speed printing.

Still further, as to system adjustment, stable transport of sheets of paper by way of impression and delivery cylinders can principally be adjusted according to the present invention, which in this respect can as well provide a system that can meet with a requirement for high speed printing.

BEST MODES FOR CARRYING OUT THE INVENTION

Figure 1:
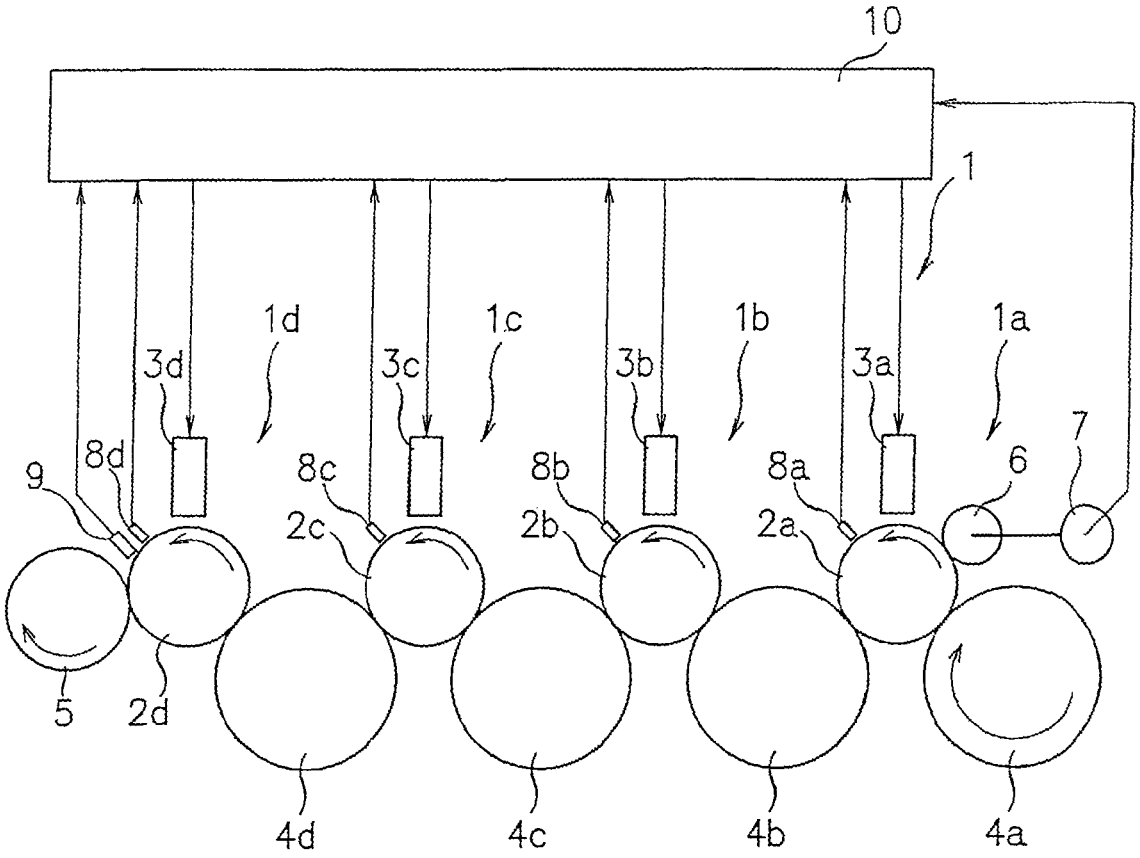
FIG. 1 is an explanatory view schematically illustrating a digital sheet-fed printing machine for carrying out a method of the present invention.

An explanation is given of one form of implementation of the present invention with reference to the Drawing Figures.

FIG. 1 shows schematically a digital sheet-fed printing machine 1 for printing in four colors on one side of a sheet of paper by using four printing units 1*a*, 1*b*, 1*c* and 1*d* each of which is here an ink jet printer. The digital sheet-fed printing machine 1 includes an impression cylinder 2*a*, 2*b*, 2*c*, 2*d* to which a printing head 3*a*, 3*b*, 3*d*, 3*d* of the printing units 1*a*, 1*b*, 1*c*, 1*d* are opposite, respectively. The machine 1 as shown also includes a first sheet delivery cylinder 4*a* for delivering a sheet of paper onto the first impression cylinder 2*a*, a second delivery cylinder 4*b* for delivering a sheet of paper from the first impression cylinder 2*a* onto the second impression cylinder 2*b*, a third and a fourth delivery cylinder 4*c*, 4*d* for delivering a sheet of paper likewise from the upstream impression cylinder onto the downstream impression cylinder, and a receiving cylinder 5 for accepting a sheet of paper from the fourth, downstream most, impression cylinder 2*d*.

Here, each impression cylinder 2*a*, 2*b*, 2*c*, 2*d* is a twofold cylinder that has a peripheral length two times of a length of the sheet of paper on its transport direction. And, each delivery cylinder 4*a*, 4*b*, 4*c*, 4*d* is a triple cylinder that has a peripheral length three times of the length of the sheet of paper in its transport direction. These cylinders are driven to rotate at the same peripheral speed. The impression cylinder 2*a*, 2*b*, 2*c*, 2*d* is provided at its circumferentially bisectional positions with two grippers (a, b), respectively, and the delivery cylinder 4*a*, 4*b*, 4*c*, 4*d* is provided at its circumferentially tri-sectional positions with three grippers (x, y, z), respectively, so that in transportation, sheets of paper successively gripped by the grippers on the first delivery cylinder 4*a* are in turn delivered to and gripped by the grippers on the first impression cylinder 2*a*, then in turn delivered to and gripped by the grippers on the second delivery cylinder 4*b*, and thereafter in turn delivered to and gripped by the grippers on each succeeding cylinder.

It should be noted here that sizes of the peripheral lengths of the impression cylinder 2*a*, 2*b*, 2*c*, 2*d* and the delivery cylinder 4*a*, 4*b*, 4*c*, 4*d* such as being two and three times of the length of a sheet of paper in its transport direction are those that can each be optionally chosen on design in the printing units 1*a*, 1*b*, 1*c* and 1*d*.

Shown connected to the first impression cylinder 2*a* is a rotation detecting gear (reference-phase detecting gear) 6 for detecting a rotation of the impression cylinder 2*a*. The rotation detecting gear 6 is designed to make one rotation each time the first impression cylinder 2*a* is rotated by a degree corresponding to one sheet of paper, i.e., each time the impression cylinder 2*a* makes a ½ rotation. A rotational position of the rotation detecting gear 6 is sensed by an encoder 7 from which a sensing signal is issued.

Opposite to the impression cylinder 2*a*, 2*b*, 2*c*, 2*d* there is also provided a mark sensor 8*a*, 8*b*, 8*c*, 8*d* serving as an image detecting sensor for detecting a timing mark to be described which has been printed by the printing head 3*a*, 3*b*, 3*c*, 3*d* in the printing unit 1*a*, 1*b*, 1*c*, 1*d* and on a sheet of paper conveyed by the impression cylinder 2*a*, 2*b*, 2*c*, 2*d*.

Also, downstream in rotary direction from a position on the impression cylinder 2*d* for the fourth printing unit 1*d* at which the mark sensor 8*d* is opposite thereto, there is provided a measuring camera 9 serving as an image detecting sensor for actually measuring an amount of deviation of the timing mark printed by the printing unit 1*a*, 1*b*, 1*c*, 1*d*.

In the makeup mentioned above, as shown in FIG. 2 the impression cylinder 2*a*, 2*b*, 2*c*, 2*d* and the delivery cylinder 4*a*, 4*b*, 4*c*, 4*d* are provided on their peripheral surfaces with two grippers a and b and three grippers x, y and z at their circumferentially bisectional and tri-sectional positions, respectively. While providing such grippers in this case requires these cylinders to be circumferentially divided precisely into two and three identical sections, there are common limitations in the machining accuracy of dividing. Also, since to such machining inaccuracies there is added a lack of uniformity in assembling accuracy for each sectional position in which a gripper structure is incorporated, unevenness in position of transport of a sheet of paper for each of grippers may be created, due to a mechanical error in their shape, in front and in rear of each sheet of paper in its transport direction.

Figure 2:
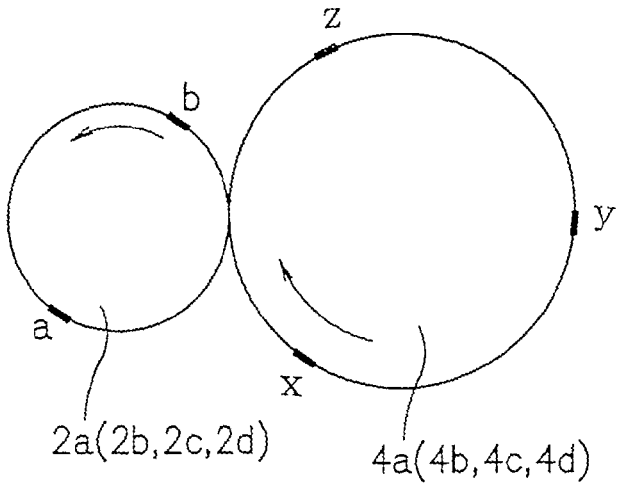
FIG. 2 is an explanatory view illustrating a relationship in position between grippers on an impression cylinder that is a twofold cylinder and grippers on a delivery cylinder that is a threefold cylinder.

In the digital sheet-fed printing machine 1 made up as shown in FIG. 1 in which the impression cylinder 2*a*, 2*b*, 2*c*, 2*d* is provided with the first and second grippers a and b, and the delivery cylinder 4*a*, 4*b*, 4*c*, 4*d* is provided with the first, second and third grippers x, y and z as shown in FIG. 2, a plurality of sheets of paper A, B, C, D, . . . are successively fed, each of sheets of paper passing through the printing units 1*a*, 1*b*, 1*c* and 1*d* successively. Then, a first sheet of paper A as shown in Table 1 below is transported as it is gripped by the first gripper (4*a*-*x*) on the first delivery cylinder 4*a* and gripped in turns by the first gripper (2*a*-*a*) on the first impression cylinder 2*a*, the first gripper (4*b*-*x*) on the second delivery cylinder 4*b*, the first gripper (2*b*-*a*) on the second impression cylinder 2*b*, the first gripper (4*c*-*x*) on the third delivery cylinder 4*c*, the first gripper (2*c*-*a*) on the third impression cylinder 2*c*, the first gripper (4*d*-*x*) on the fourth delivery cylinder 4*d* and the first gripper (2*d*-*a*) on the fourth impression cylinder 2*d* for acceptance by the receiving cylinder 5. The sheet of paper A in the meantime is printed on in a respective color by the printing head for each of the impression cylinders 2*a*, 2*b*, 2*c* and 2*d* where it is opposite to the sheet of paper A. A pattern of printing in four colors on the first sheet of paper A is designated to be a first printing pattern P1.

TABLE 1

| Sheet symbol | G num. on 1st Dl Cy | G num. on 1st Imp Cy | G num. on 2nd Dl Cy | G num. on 2nd Imp Cy | G num. on 3rd Dl Cy | G num. on 3rd Imp Cy | G num. on 4th Dl Cy | G num. on 4th Imp Cy | Printing Pattern |
|---|---|---|---|---|---|---|---|---|---|
| A | 4a-x | 2a-a | 4b-x | 2b-a | 4c-x | 2c-a | 4d-x | 2d-a | P1 |
| B | 4a-y | 2a-b | 4b-y | 2b-b | 4c-y | 2c-b | 4d-y | 2d-b | P2 |
| C | 4a-z | 2a-a | 4b-z | 2b-a | 4c-z | 2c-a | 4d-z | 2d-a | P3 |
| D | 4a-x | 2a-b | 4b-x | 2b-b | 4c-x | 2c-b | 4d-x | 2d-b | P4 |
| E | 4a-y | 2a-a | 4b-y | 2b-a | 4c-y | 2c-a | 4d-y | 2d-a | P5 |
| F | 4a-z | 2a-b | 4b-z | 2b-b | 4c-z | 2c-b | 4d-z | 2d-b | P6 |
| G | 4a-x | 2a-a | 4b-x | 2b-a | 4c-x | 2c-a | 4d-x | 2d-a | P1 |
| H | 4a-y | 2a-b | 4b-y | 2b-b | 4c-y | 2c-b | 4d-y | 2d-b | P2 |
| I | 4a-z | 2a-a | 4b-z | 2b-a | 4c-z | 2c-a | 4d-z | 2d-a | P3 |
| J | 4a-x | 2a-b | 4b-x | 2b-b | 4c-x | 2c-b | 4d-x | 2d-b | P4 |
| . | | | | | | | | | |
| . | | | | | | | | | |
| . | | | | | | | | | |

G: Gripper
num: Number
Dl Cy: Delivery Cylinder
Imp Cy: Impression Cylinder

Next, a second sheet of paper B as shown in Table 1 is transported as it is gripped by the second gripper (4*a*-*y*) on the first delivery cylinder 4*a* and gripped in turns by the second gripper (2*a*-*b*) on the first impression cylinder 2*a*, the second gripper (4*b*-*y*) on the second delivery cylinder 4*b*, the second gripper (2*b*-*b*) on the second impression cylinder 2*b*, the second gripper (4*c*-*y*) on the third delivery cylinder 4*c*, the second gripper (2*c*-*b*) on the third impression cylinder 2*c*, the second gripper (4*d*-*y*) on the fourth delivery cylinder 4*d* and the second gripper (2*d*-*b*) on the fourth impression cylinder 2*d*. The second sheet of paper B in the meantime is printed on in four colors. A pattern of printing in four colors on the second sheet of paper B is designated to be a second printing pattern P2.

Next, a third sheet of paper C as shown in Table 1 is transported as it is gripped by the third gripper (4*a*-*z*) on the first delivery cylinder 4*a* and gripped in turns by the first gripper (2*a*-*a*) on the first impression cylinder 2*a*, the third gripper (4*b*-*z*) on the second delivery cylinder 4*b*, the first gripper (2*b*-*a*) on the second impression cylinder 2*b*, the third gripper (4*c*-*z*) on the third delivery cylinder 4*c*, the first gripper (2*c*-*a*) on the third impression cylinder 2*c*, the third gripper (4*d*-*z*) on the fourth delivery cylinder 4*d* and the first gripper (2*d*-*a*) on the fourth impression cylinder 2*d*. The third sheet of paper C in the meantime is printed on in four colors. A pattern of printing in four colors on the third sheet of paper C is designated to be a third printing pattern P3.

Next, a fourth sheet of paper D as shown in Table 1 is transported as it is gripped by the first gripper (4*a*-*x*) on the first delivery cylinder 4*a* and gripped in turns by the second gripper (2*a*-*b*) on the first impression cylinder 2*a*, the first gripper (4*b*-*x*) on the second delivery cylinder 4*b*, the second gripper (2*b*-*b*) on the second impression cylinder 2*b*, the first gripper (4*c*-*x*) on the third delivery cylinder 4*c*, the second gripper (2*c*-*b*) on the third impression cylinder 2*c*, the first gripper (4*d*-*x*) on the fourth delivery cylinder 4*d* and the second gripper (2*d*-*b*) on the fourth impression cylinder 2*d*. The fourth sheet of paper D in the meantime is printed on in four colors. A pattern of printing in four colors on the fourth sheet of paper D is designated to be a fourth printing pattern P4.

Thereafter, a fifth sheet of paper E as shown in Table 1 is transported as it is gripped in turns by respective grippers (4*a*-*y*), (2*a*-*a*), (4*b*-*y*), (2*b*-*a*), (4*c*-*y*), (2*c*-*a*), (4*d*-*y*) and (2*d*-*a*) of these cylinders and in the meantime is printed on in four colors. A pattern of printing in four colors on the fifth sheet of paper E is designated to be a fifth printing pattern P5.

A sixth sheet of paper F as shown in Table 1 is transported as it is gripped in turns by respective grippers (4*a*-*z*), (2*a*-*b*), (4*b*-*z*), (2*b*-*b*), (4*c*-*z*), (2*c*-*b*), (4*d*-*z*) and (2*d*-*b*) of these cylinders and in the meantime is printed on in four colors. A pattern of printing in four colors on the sixth sheet of paper F is designated to be a sixth printing pattern P6.

Three (3) in number of grippers on the delivery cylinder 4*a*, 4*b*, 4*c*, 4*d* and two (2) in number of grippers on the impression cylinder 2*a*, 2*b*, 2*c*, 2*d* making their least common multiple of six (6), the seventh sheet G and those thereafter H, I, J, . . . are transported while being gripped in turns, repeating one cycle consisting of transport of the first to sixth sheets of paper, i.e., one cycle consisting of the first to sixth printing patterns P1 to P6.

Each time one sheet of paper is transported by a distance in the first printing unit 1*a* in the transport of sheets of paper, the rotation detecting gear 6 makes one rotation, which is detected by the encoder 7. A detection signal representing such one rotation is furnished as a reference signal into a printing control unit 10. At a selected position during each such one rotation, a printing command is issued from the control unit 10 to the printing head 3*a*, 3*b*, 3*c*, 3*d* of each printing unit 1*a*, 1*b*, 1*c*, 1*d*, respectively.

To wit, from the control unit 10 in response to each such reference signal a printing command for printing on each sheet of paper is issued, as timed by computation to its passage beneath the printing head 3*a*, 3*b*, 3*c*, 3*d* of the printing unit 1*a*, 1*b*, 1*c*, 1*d*, so that on each sheet of paper transported following each printing pattern P1, P2, P3, P4, P5, P6, a timing mark in conjunction with an image in each color can be printed by the printing head 3*a*, 3*b*, 3*c*, 3*d* of each printing unit 1*a*, 1*b*, 1*c*, 1*d* in accordance with each printing command from the control unit 10. Note further, here, that such a timing mark is printed at a selected position that deviates from its associated image on each sheet of paper and that is slightly displaced widthwise of the sheet of paper for each printing unit 1*a*, 1*b*, 1*c*, 1*d*.

Figure 3A:
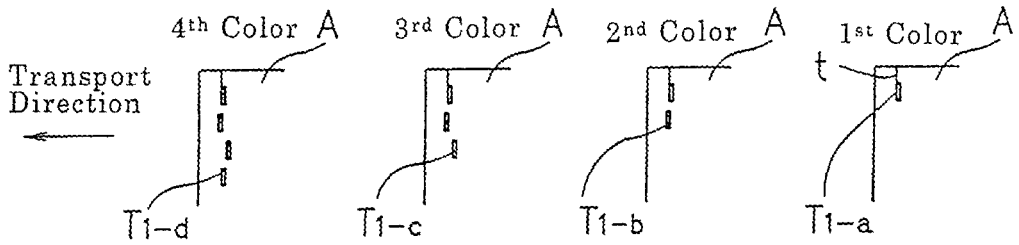
FIGS. 3A, 3B and 3C are explanatory views illustrating states of deviation in position of timing marks when printing in four colors using an impression cylinder that is a twofold cylinder and a delivery cylinder that is a threefold cylinder.

FIG. 3A shows timing marks T1-*a*, T1-*b*, T1-*c* and T1-*d* printed in the first printing pattern P1 on a first sheet of paper A by the printing units 1*a*, 1*b*, 1*c* and 1*d*, respectively. In this figure, t designates an auxiliary line representing a reference mark position provided for the sake of convenience, i.e. a virtual reference position in a case where the first color timing mark is assumed as a reference, and may not be actually printed. FIGS. B and C shows timing marks printed in the printing patterns P2 and P3 on the second and third sheet of paper B and C, respectively. In the fourth to sixth printing patterns P4 to P6 though not shown, their respective timing marks are likewise printed on the fourth to sixth sheets of paper D to F, respectively.

Figure 3B:
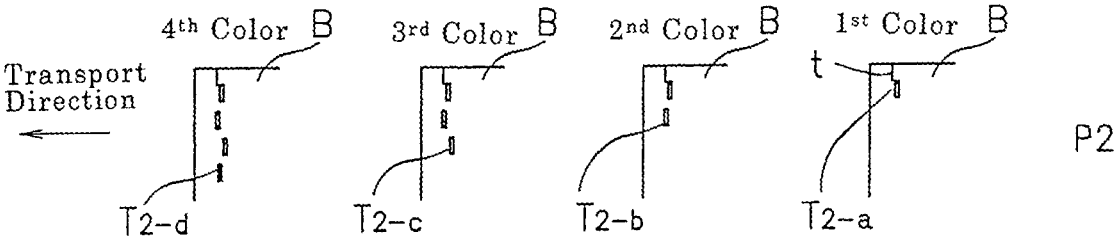
Figure 3C:
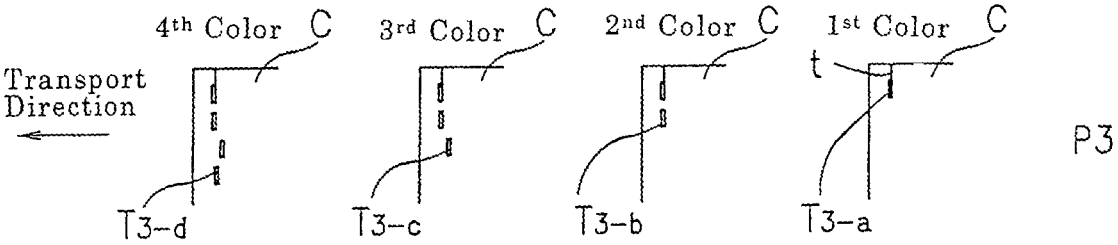

It is shown that the four (four color) timing marks printed in four or the $1^{st}$ to $4^{th}$ colors on a sheet of paper in each of the printing patterns P1 to P6 are printed as deviated in position in the sheet transport direction as shown in FIGS. 3A to 3C due to a specific error introduced for each of the grippers in each of the printing patterns P1 to P6. This indicates that it may likewise result that four (four color) images successively printed by the printing units 1*a* to 1*d* are deviated in position in the sheet transport direction. Although shown in FIGS. 3A to 3C on three sheets of paper A, B and C, it should be noted in this form of implementation that printing of images deviated in position as such is repeated for each cycle consisting of transport of six sheets of paper.

Thus, brought about by printing in the first to fourth colors on a sheet during each cycle consisting of transport of six sheets, deviation in position of four printed timing marks indicates deviation in position of four printed images, requiring that each of the printing units 1*a* to 1*d* be individually adjusted in timing to print so that these timing marks may be coincided in position with one another When each of printings on six consecutive sheets of paper A to F in one cycle has been successively completed as mentioned above, each of sets of timing marks T1-*a* to T1-*d*, T2-*a* to T2-*d*, T3-*a* to T3-*d*, T4-*a* to T4-*d*, T5-*a* to T5-*d* and T6-*a* to T6-*d* printed on these sheets of paper in the first to fourth colors is successively, e.g., photographed by a measuring camera, to actually measure the positions of the four timing marks on, e.g., their distances from the downstream end in sheet transport direction, of each of the sheets of paper A to F. Sets of measurement values for the sheets of paper A to F are successively inputted or entered as position data D1, D2, D3, D4, D5 and D6 into the control unit 10.

These position data D1 to D6 then each contains position data of the timing marks in the four colors. Specifically, the position data D1 for the first sheet of paper A contains position data d1-*a*, d1-*b*, d1-*c* and d1-*d* of timing marks in four colors, the position data D2 for the second sheet of paper B contains position data d2-*a*, d2-*b*, d2-*c* and d2-*d* of timing marks in four colors, the position data D3 for the third sheet of paper C contains position data d3-*a*, d3-*b*, d3-*c* and d3-*d* of timing marks in four colors, and likewise the position data D4, D5 and D6 contain respective position data of timing marks in the four colors. These specific position data are those in the four colors for each of the six sheets of paper, which in total are 24 in number.

In the control unit 10, timings to print with printing commands for output to the printing heads 3*a*-3*d* in the printing units 1*a*-1*d* from the control unit 10 in response to detection signals received as reference signals from the encoder 7 are computed on the basis of these respective position data D1-D6 (timing mark position data) for the sheets of paper A-F. And, the timings to print for output to the respective printing heads are corrected so that the timings to print with the position data of the different colors for the different sheets may be coincided with one another, e.g., the timings to print with the position data other than the position datum d1-*a* of the first color in the position data D1 for the first sheet of paper (hereinafter referred to as the other position data) may be coincided with the timing to print with the position datum d1-*a* of the first color.

The position data D1-D6 mentioned above are used to obtain data of fixed correction values for the six successive sheets of paper A-F in one cycle consisting of six printing patterns where 6 is the least common multiple of 2: two grippers provided on each impression cylinder and 3: three grippers provided on each delivery cylinder.

Specifically, in the first printing pattern P1 which is one of the six printing patterns in one cycle and in which timing marks are printed on the sheet of paper A with the printing heads 3*a*-3*d* in the printing units 1*a*-1*d* by printing commands from the control unit 10, input of the position data D1 (d1-*a*, d1-*b*, d1-*c* and d1-*d*) in the first printing pattern P1 into the control unit 10 corrects the timings to print the timing marks T1-*b* (in the second color with the second printing head 3*b*), T1-*c* (in the third color with the third printing head 3*c*) and T1-*d* (in the fourth color with the fourth printing head 3*d*) so as to be coincided with the timing to print the timing mark T1-*a* (in the first color with the first printing head 3*a*).

Likewise in the following, in the second to sixth printing patterns P2-P6, inputs of the position data D2-D6 in the printing patterns P2-P6 into the control unit 10 respectively correct the timings to print the timing marks on the sheets of paper B, C, D, F and F with the first to fourth printing heads 3*a*-3*d* so as to be coincided with the timing to print the first timing mark T1-*a* on the first sheet of paper A and in the first printing pattern P1.

In this manner, by inputting the printing data D1-D6 into the control unit 10, the timings to print the timing marks in the four colors on the sheets of papers A-F in the printing patterns P1-P6 in one cycle in which six sheets of paper are transported are corrected so as to be coincided with the timing to print the first timing mark T1-*a* on the first sheet of paper A in the first printing cycle, the so-corrected data constituting the fixed data of correction values for every six sheets of paper thereafter.

Respective timing marks for printing on a first to a sixth sheets of paper by so corrected timings are thus printed so as to be coincident in position with the first timing mark T1-*a* on the first sheet of paper A.

Subsequent to printing of the printing patterns P1-P6 in the first printing cycle, sheets of paper G, H, I, . . . by sixes are printed, respectively, in the printing patterns P1-P6 in the second, third, . . . printing cycles on the basis of data of correction values fixed on the printing patterns P1-P6 in the first printing cycle as mentioned above. Consequently, the respective timing marks in the four colors on the six sheets of paper in each printing cycle are agreed in position in sheet transport direction with the timing mark Ta-1 on the first sheet of paper in the first printing cycle with the result that there is no out of register between the printed images in the four colors on each of the sheets of paper.

Data of correction values for each of sheets of paper A-F for printing respectively in the four printing patterns P1-P6 in the first printing cycle can be acquired in another way. As mentioned in connection with FIG. 1, a detection signal (reference signal) is furnished into the control unit 10 by the encoder 7 designed to detect a selected position of rotation of the rotation detecting gear 6 adapted to make one rotation each time a sheet of paper is transported by a distance. The control unit 10 as mentioned is also furnished with a detection signal by the mark sensor 8*a*, 8*b*, 8*c*, 8*d* designed individually to detect a timing mark immediately after it is printed by the printing head 3*a*, 3*b*, 3*c*, 3*d*. These signals allow a position of the timing mark printed by each of the printing units 1*b*, 1*c*, 1*d* to be detected using as a reference a position of the timing mark printed by the first printing unit 1*a* on the first sheet of paper or a position of a virtual reference line t, thereby making it possible to acquire registering error data.

Such a method of acquiring registering error data with the mark sensors 8*a*-8*d* can also be used as a means to automatically control an out of register that may occur while the machine is working due to a factor other than an error generated for each cycle due to a mechanical shape error of a printing unit or units *a*-1*d*.

Also, while the form of implementation illustrates use of an impression cylinder that is a twofold cylinder having two grippers and a delivery cylinder that is a threefold cylinder having three grippers, i.e., a transport cylinder made up of a combination of a twofold cylinder, a threefold cylinder, a twofold cylinder . . . , it should be noted that any combination of plural multiples of such cylinders is possible. In any case, there is equipped a periodicity of repetition of a number in transport of sheets of paper which is equal to the least common multiple of respective multiples of an impression and a delivery cylinders and the method can likewise be applied where the combination is varied.

Further, while the printing unit comprising an ink jet printer is illustrated, it should be noted that the printing unit may comprise an electrophotographic printer to achieve entirely similar effects.

According to the present invention, after performing a conventional mechanical adjustment of precision within the limits of possibility it is possible to further correct an error in accordance with the method described above, thereby making it possible to perform a high precision adjustment that has hitherto been technically impracticable. It is further possible to take a plurality of error detection samples to use an average value of detected errors, thereby making it possible to achieve effective results.

Further, taking a plurality of samples can be performed utilizing mark sensors to achieve an adjustment that is high in precision and that is less burdensome operationally. Also, to detect an error, a method other than using a camera photographic image may suitably be chosen.

Still further, the method of detecting a timing mark or a portion of an image with a sensor or camera in each printing unit to acquire fixed correction values in the adjustment step can be applied to detect an additional register error that may be produced arising from its tendency to be deviated in one fixed direction due principally to such as a change in operating speed of the apparatus. And, the method can be used to achieve, on the basis of the detection data, an extended error detecting function to automatically control an out of register during operations.

Also, while in the foregoing description, the impression cylinder is illustrated as a twofold cylinder and the delivery cylinder as a threefold cylinder, the present invention can also be applied to where each of respective numbers of multiples of an impression and a delivery cylinder is 2 or more and they are equal to each other and where their least common multiple is 2 or more.

What is claimed is:

1. A digital sheet-fed printing method for multi-color printing on a sheet of paper with a plurality of printing units of digital type, each for printing in each of different colors, in which sheets of paper are successively transported through the printing units with a plurality of transport cylinders individually having a peripheral length that allows sheets of paper to be transported thereon while being retained at their circumferentially uniformly distributed allocated positions, characterized in that the method comprising the steps of:

providing one cycle of printing to print on a series of sheets of paper whose number is equal to the least common multiple of respective numbers of such distributed allocated positions on adjacent ones of said transport cylinders;

for each sheet of paper in said series of sheets to be printed in the one cycle of printing, producing a reference signal on a basis of which an image in each color is printed on the sheet of paper with each printing unit, timed to the sheet of paper passage through the printing unit, under control by a printing control means;

in a first of such cycles of printing, detecting with an image detection sensor means a mutual out of register between images in different colors printed on each sheet of paper in said series, furnishing said printing control means with a detection signal for each sheet of paper from said image detection sensor means, and correcting timing at which each image is printed on each sheet of paper in one cycle of printing by said printing control means and on the basis of such detection signals so that timings to print each image in different colors on each sheet of paper may be coincided with one another;

and in each subsequent printing cycle, printing images in the different colors on each sheet of paper at a printing timing as corrected as aforesaid.

2. A digital sheet-fed printing method as set forth in claim 1, characterized in that said mutual out of register between images in different colors printed on each sheet of paper printed in the first printing cycle is detected by detecting one of:

(i) an amount of deviation in distance between a timing mark contained in an image in each color and an end of each sheet of paper in its transport direction; and (ii) an amount of deviation between a timing mark contained in one of images in different colors and a timing mark contained in another of the images.

3. A digital sheet-fed printing method as set forth in claim 2, characterized in that said image detecting sensor means comprises one of a measuring camera and a mark sensor.

4. A digital sheet-fed printing method as set forth in claim 2, characterized in that a said printing unit of digital type comprises one of an ink jet printer and an electrophotographic printer.

5. A digital sheet-fed printing method as set forth in claim 2, characterized in that said adjacent ones of the transport cylinders with which sheets of paper are successively transported through said printing units comprise an impression cylinder to which a said printing unit is opposite and one of a pair of delivery cylinders positioned at upstream and downstream sides of the impression cylinder in its transporting direction, wherein said impression and delivery cylinders have their peripheral lengths which are varied from each other such as being two and three times, respectively, of than a length of the sheet of paper in its transport direction.

6. A digital sheet-fed printing method as set forth in claim 1, characterized in that said image detection sensor means is adapted to detect the timing at which an image passes immediately after the image is printed on each sheet of paper in the first cycle of printing to compensate for an error in timing between a detection signal detected by said image detection sensor means and the reference signal produced for each printing in each color on a sheet of paper by said printing control means.

7. A digital sheet-fed printing method as set forth in claim 6, characterized in that said image detecting sensor means comprises one of a measuring camera and a mark sensor.

8. A digital sheet-fed printing method as set forth in claim 6, characterized in that a said printing unit of digital type comprises one of an ink jet printer and an electrophotographic printer.

9. A digital sheet-fed printing method as set forth in claim 6, characterized in that said adjacent ones of the transport cylinders with which sheets of paper are successively transported through said printing units comprise an impression cylinder to which a said printing unit is opposite and one of a pair of delivery cylinders positioned at upstream and downstream sides of the impression cylinder in its transporting direction, wherein said impression and delivery cylinders have their peripheral lengths which are varied from each other such as being two and three times, respectively, of than a length of the sheet of paper in its transport direction.

10. A digital sheet-fed printing method as set forth in claim 1, characterized in that said image detecting sensor means comprises one of a measuring camera and a mark sensor.

11. A digital sheet-fed printing method as set forth in claim 10, characterized in that said adjacent ones of the transport cylinders with which sheets of paper are successively transported through said printing units comprise an impression cylinder to which a said printing unit is opposite and one of a pair of delivery cylinders positioned at upstream and downstream sides of the impression cylinder in its transporting direction, wherein said impression and delivery cylinders have their peripheral lengths which are varied from each other such as being two and three times, respectively, of than a length of the sheet of paper in its transport direction.

12. A digital sheet-fed printing method as set forth in claim 1, characterized in that a said printing unit of digital type comprises one of an ink jet printer and an electrophotographic printer.

13. A digital sheet-fed printing method as set forth in claim 12, characterized in that said adjacent ones of the transport cylinders with which sheets of paper are successively transported through said printing units comprise an impression cylinder to which a said printing unit is opposite and one of a pair of delivery cylinders positioned at upstream and downstream sides of the impression cylinder in its transporting direction, wherein said impression and delivery cylinders have their peripheral lengths which are varied from each other such as being two and three times, respectively, of than a length of the sheet of paper in its transport direction.

14. A digital sheet-fed printing method as set forth in claim 1, characterized in that said adjacent ones of the transport cylinders with which sheets of paper are successively transported through said printing units comprise an impression cylinder to which a said printing unit is opposite and one of a pair of delivery cylinders positioned at upstream and downstream sides of the impression cylinder in its transporting direction, wherein said impression and delivery cylinders have their peripheral lengths which are varied from each other such as being two and three times, respectively, of than a length of the sheet of paper in its transport direction.

* * * * *